US010689244B1

(12) United States Patent
LeCroix

(10) Patent No.: US 10,689,244 B1
(45) Date of Patent: Jun. 23, 2020

(54) ASSISTANCE LEVER FOR A FUEL NOZZLE

(71) Applicant: Ray LeCroix, Rogersville, AL (US)

(72) Inventor: Ray LeCroix, Rogersville, AL (US)

( * ) Notice: Subject to any disclaimer, the term of this patent is extended or adjusted under 35 U.S.C. 154(b) by 22 days.

(21) Appl. No.: 16/059,257

(22) Filed: Aug. 9, 2018

(51) Int. Cl.
*B67D 7/42* (2010.01)
*B67D 7/50* (2010.01)

(52) U.S. Cl.
CPC . *B67D 7/42* (2013.01); *B67D 7/50* (2013.01)

(58) Field of Classification Search
CPC ..... B67D 7/42; B67D 7/50
USPC ..... 141/392
See application file for complete search history.

(56) References Cited

U.S. PATENT DOCUMENTS

| | | | | |
|---|---|---|---|---|
| 4,337,917 | A | 7/1982 | Tesack et al. | |
| 6,070,625 | A | 6/2000 | Robinson et al. | |
| 6,279,621 | B1 | 8/2001 | Gelsomino | |
| 7,040,361 | B2 | 5/2006 | Soussan et al. | |
| 8,662,119 | B2 | 3/2014 | Burris et al. | |
| 2005/0061397 | A1* | 3/2005 | Mendicino ..... | B67D 7/42 141/392 |
| 2009/0056844 | A1 | 3/2009 | Schanz | |

OTHER PUBLICATIONS

Gas Bud-E Hands Free Fueling Clip—discontinued; retrieved from https://www.arthritissupplies.com/gas-bud-e-hands-free-fuel-clip.html; retrieved on Feb. 19, 2018.

* cited by examiner

*Primary Examiner* — Jessica Cahill
*Assistant Examiner* — Christopher M Afful
(74) *Attorney, Agent, or Firm* — David W. Holt; Dennis Núñez; Bradley Arant Boult Cummings LLP

(57) ABSTRACT

An assistance lever that assists a user when operating a fuel nozzle at a fuel dispenser is disclosed. In one embodiment, the assistance lever includes a fulcrum post, a handle post, a support arm, and a press member. The fulcrum post is positionable on a top ridge of the fuel nozzle. The support arm is connected between the fulcrum post and the handle post such that the handle post is positionable beneath a handle of the fuel nozzle. The press member is attached to the fulcrum post and positioned to turn the assistance lever about the fulcrum post when pressed by the user such that the handle post presses the handle of the fuel nozzle. In this manner, a user can simply use their weight to push on the press member, which thereby presses the handle of the fuel nozzle.

20 Claims, 4 Drawing Sheets

ASSISTANCE LEVER FOR A FUEL NOZZLE

FIELD OF THE DISCLOSURE

This disclosure relates generally to an assistance lever that assists a user to operate a fuel nozzle at a fuel dispenser.

BACKGROUND

Fuel dispensers, such as gas pumps, are often used to provide fuel to vehicles or to fill containers designed to store fuel. However, fuel dispensers typically have a fuel nozzle, which must be operated in order to pump the fuel into a vehicle or a container. To operate the fuel nozzle, a user grips the nozzle and presses the handle upward with their hand. Unfortunately, some users are not capable of creating sufficient force with their hands so as to operate the fuel nozzle. For example, the disabled and the elderly can suffer from physical ailments (e.g., arthritis) that prevent them from generating sufficient force with their hands so as to press the handle and operate the fuel nozzle.

Accordingly, new techniques are needed to assist the disabled and the elderly when operating the fuel nozzle of a fuel dispenser.

SUMMARY

An assistance lever that assists a user when operating a fuel nozzle at a fuel dispenser is disclosed. In one embodiment, the assistance lever includes a fulcrum post, a handle post, a support arm, and a press member. The fulcrum post is positionable on a top ridge of the fuel nozzle. The support arm is connected between the fulcrum post and the handle post such that the handle post is positionable beneath a handle of the fuel nozzle. The press member is attached to the fulcrum post and positioned to turn the assistance lever about the fulcrum post when pressed by the user such that the handle post presses the handle of the fuel nozzle. In this manner, a user can simply use their weight to push on the press member, which thereby presses the handle of the fuel nozzle. Thus, a user does not need to grip and press the handle with their hands to operate the fuel nozzle.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

Throughout this disclosure, relative terminology, such as "approximately," "substantially," "proximate" and the like, may be used in a predicate to describe features and relationships between features of a device or method. The relative terminology in the predicate should be interpreted sensu lato. However, whether the predicate employing the relative terminology is satisfied is determined in accordance to error ranges and/or variation tolerances that are relevant to the predicate and allow the feature or related features described by the predicate to perform their intended function.

It should be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

This disclosure relates generally to systems and methods of allowing a user to operate a fuel nozzle at a fuel dispenser, such as a gas pump. More specifically, embodiments of an assistance lever are disclosed, which allow a user to operate the fuel nozzle without having to grip the handle of the fuel nozzle. Instead, as explained in further detail below, the assistance lever engages the fuel nozzle in such a manner that a user can simply use their weight to press the handle of the fuel nozzle so that fuel is dispensed into the desired vehicle or container.

Figure 1:
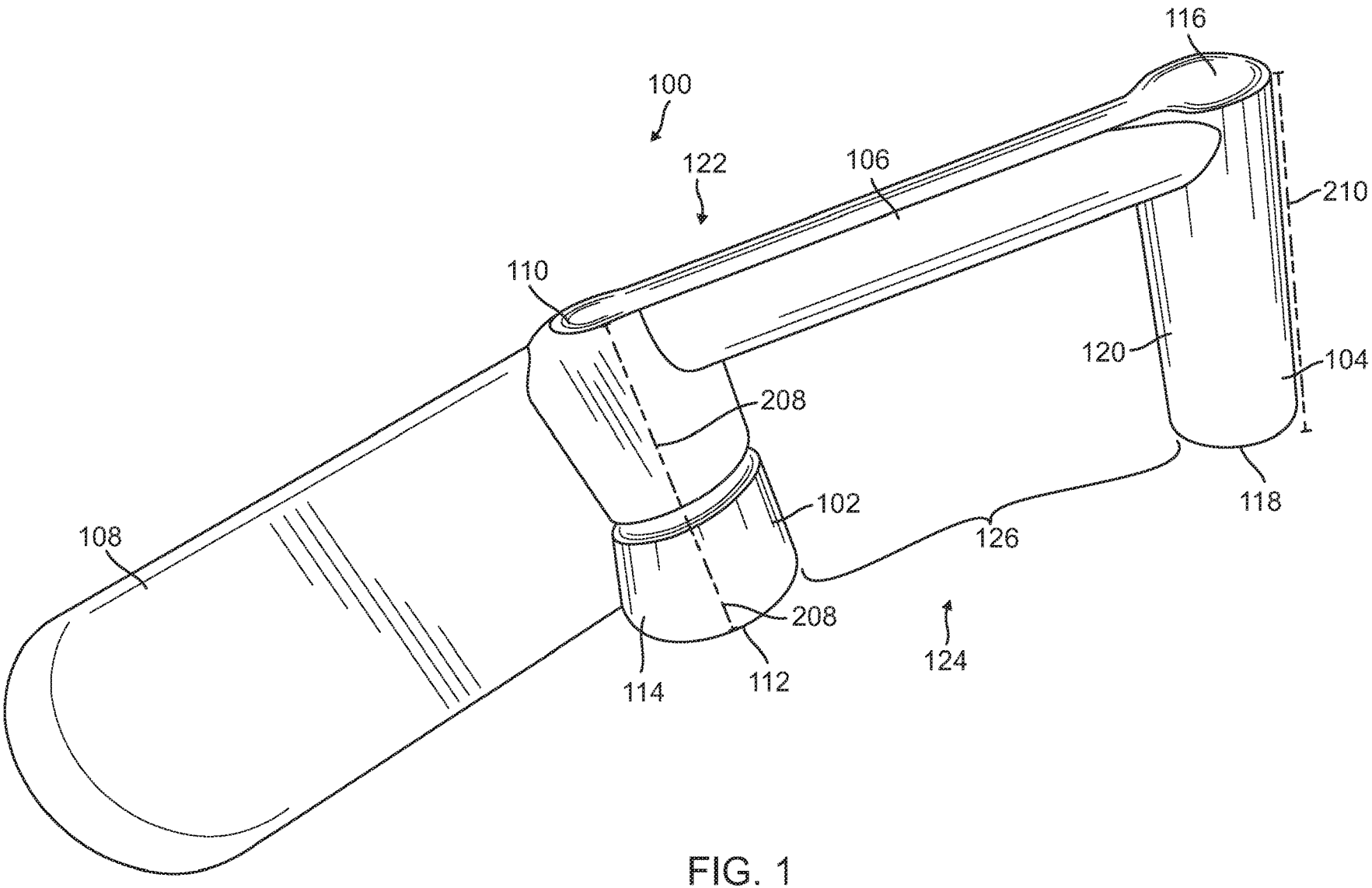
FIG. 1 illustrates a perspective view of an exemplary assistance lever.

FIG. 1 illustrates an exemplary assistance lever 100. The assistance lever 100 assists a user to operate a fuel nozzle at a fuel dispenser, as discussed in further detail below. The assistance lever 100 includes a fulcrum post 102, a handle post 104, a support arm 106, and a press member 108. The fulcrum post 102 is positionable on a top ridge of the fuel nozzle. The fulcrum post 102 provides a fulcrum for twisting the assistance lever 100 once the assistance lever 100 engages the fuel nozzle. The handle post 104 is placed underneath the handle of the fuel nozzle and is the component that engages and presses the handle of the fuel nozzle when the assistance lever 100 is turned. The support arm 106 is connected between the fulcrum post 102 and the handle post 104. In this manner, the handle post 104 is positionable beneath the handle of the fuel nozzle. The press member 108 is attached to the fulcrum post 102 and is positioned to turn the assistance lever 100 when pressed by a user such that the handle post 104 presses the handle of the fuel nozzle.

In this embodiment, the press member 108 is a press pad. The press member 108 is shaped ergonomically so as to be nearly flat but with slightly curved surfaces so as to be easily manipulated by a user's hand. Once the fulcrum post 102 has been placed on the top ridge of the fuel nozzle and the handle post 104 is placed beneath the handle of the fuel nozzle, a user can push the press member 108 towards the top ridge of the fuel nozzle. The assistance lever 100 is thus turned about the fulcrum post 102 in a counter-clockwise direction. Since the support arm 106 is connected to the fulcrum post 102 and the handle post 104, the handle post 104 is turned upwards in a counter clockwise direction when the user pushes on the press member 108. Thus, the handle post 104 pushes the handle of the fuel nozzle upwards and presses the handle so that fuel is dispensed through the fuel nozzle by the fuel dispenser. Since the press member 108 is positionable on the top ridge of the fuel nozzle, a user can use their weight to push the press member 108 toward the top ridge. In this manner, a user that is unable to grip the handle of the fuel nozzle can simply place the assistance lever 100 on the fuel nozzle as described above and use their weight to dispense fuel into the desired vehicle or container.

The features of the assistance lever 100 are provided so as to fit securely and operate smoothly on the fuel nozzle. As shown in FIG. 1, the fulcrum post 102 has an end 110 and an oppositely disposed end 112. Furthermore, the fulcrum post 102 defines a post surface 114 between and orthogonal to the ends 110, 112. In one embodiment, the fulcrum post 102 has a cross sectional area that is substantially circular or elliptical. These shapes have been selected as they make it easy to turn about a fulcrum. However, cross sectional areas of other shapes may also be used. As shown in FIG. 1, the press member 108 (e.g., the press pad) is attached to the fulcrum post 102 so as to extend out of the post surface 114 and between the ends 110, 112.

The handle post 104 has an end 116 and an oppositely disposed end 118. Furthermore, the handle post 104 defines a post surface 120 between and orthogonal to the ends 116, 118. In one embodiment, the handle post 104 has a cross sectional area that is substantially circular or elliptical. However, cross sectional areas of other shapes may also be used. As explained in further detail below, the post surface 120 of the handle post 104 engages the handle of the fuel nozzle so that the handle post 104 pushes the handle of the fuel nozzle upwards when the assistance lever 100 is turned in the counter-clockwise direction.

The assistance lever 100 is configured so as to engage the body of the fuel nozzle in a secure manner. More specifically, the assistance lever 100 has a lateral side 122 and an oppositely disposed lateral side 124. Note that the end 110 of the fulcrum post 102 and the end 116 of the handle post 104 are at the lateral side 122 of the assistance lever 100. In contrast, the end 112 of the fulcrum post 102 and the end 118 of the handle post 104 are at the lateral side 124 of the assistance lever 100. The support arm 106 is attached to the end 110 of the fulcrum post 102 and is attached to the end 116 of the handle post 104. Furthermore, the support arm 106 is relatively thin and flat. As such, a gap 126 is defined between the fulcrum post 102 and the handle post 104. In this manner, a body of the fuel nozzle can be placed in the gap 126 so that the body of the fuel nozzle is positionable between the fulcrum post 102 and the handle post 104. To engage the fuel nozzle, the fulcrum post 102 is placed on the top ridge of the fuel nozzle and the handle post 104 is positioned underneath the handle of the fuel nozzle while the body of the fuel nozzle can be placed in the gap 126 between the fulcrum post 102 and the handle post 104. To engage the fuel nozzle, the fulcrum post 102 is placed on the top ridge of the fuel nozzle and the handle post 104 is positioned underneath the handle of the fuel nozzle while the body of the fuel nozzle can be placed in the gap 126 between the fulcrum post 102 and the handle post 104.

Figure 2:
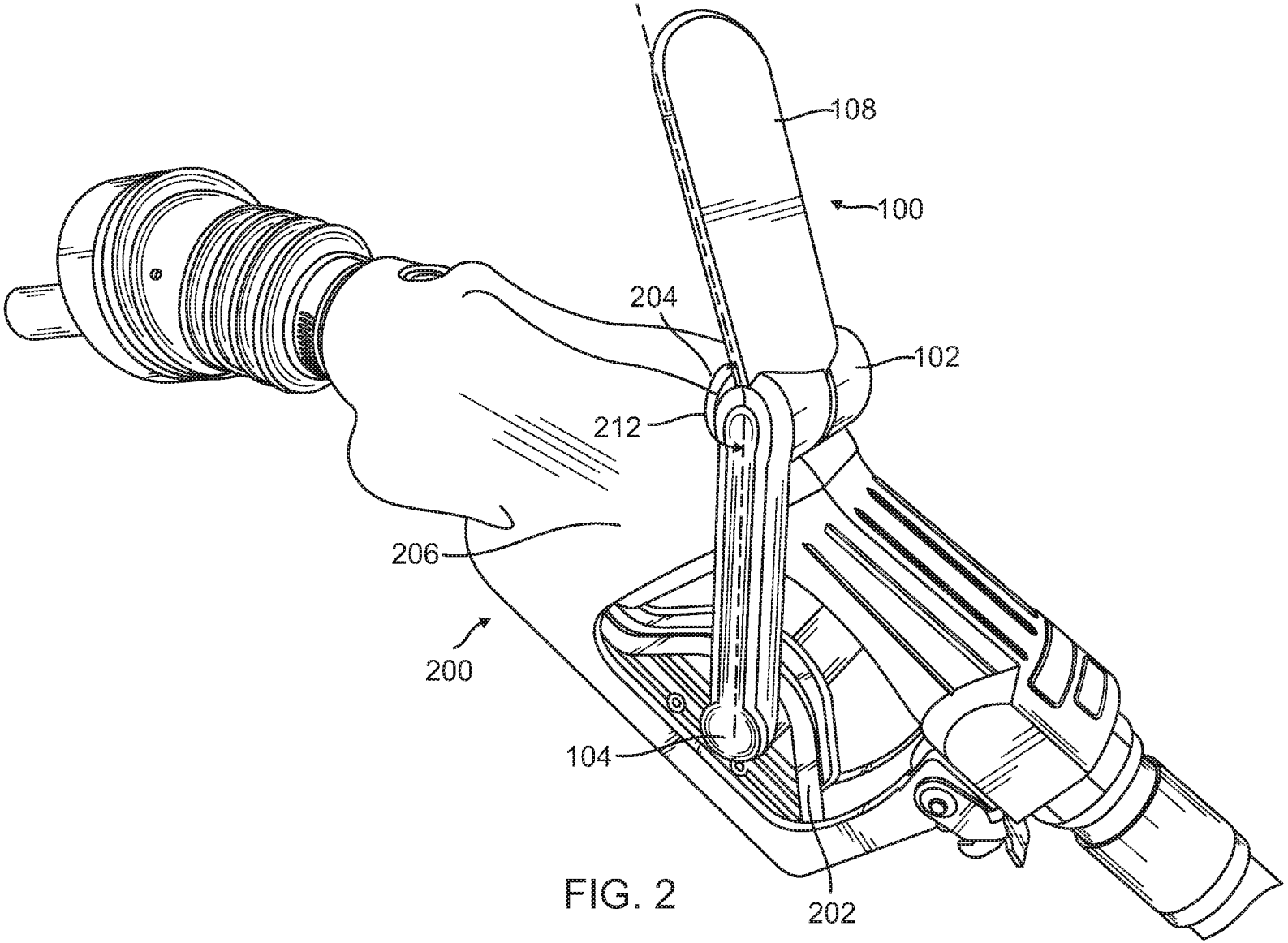
FIG. 2 illustrates the assistance lever shown in FIG. 1 mounted on a fuel nozzle before the handle of the fuel nozzle has been pressed by the assistance lever.
Figure 3:
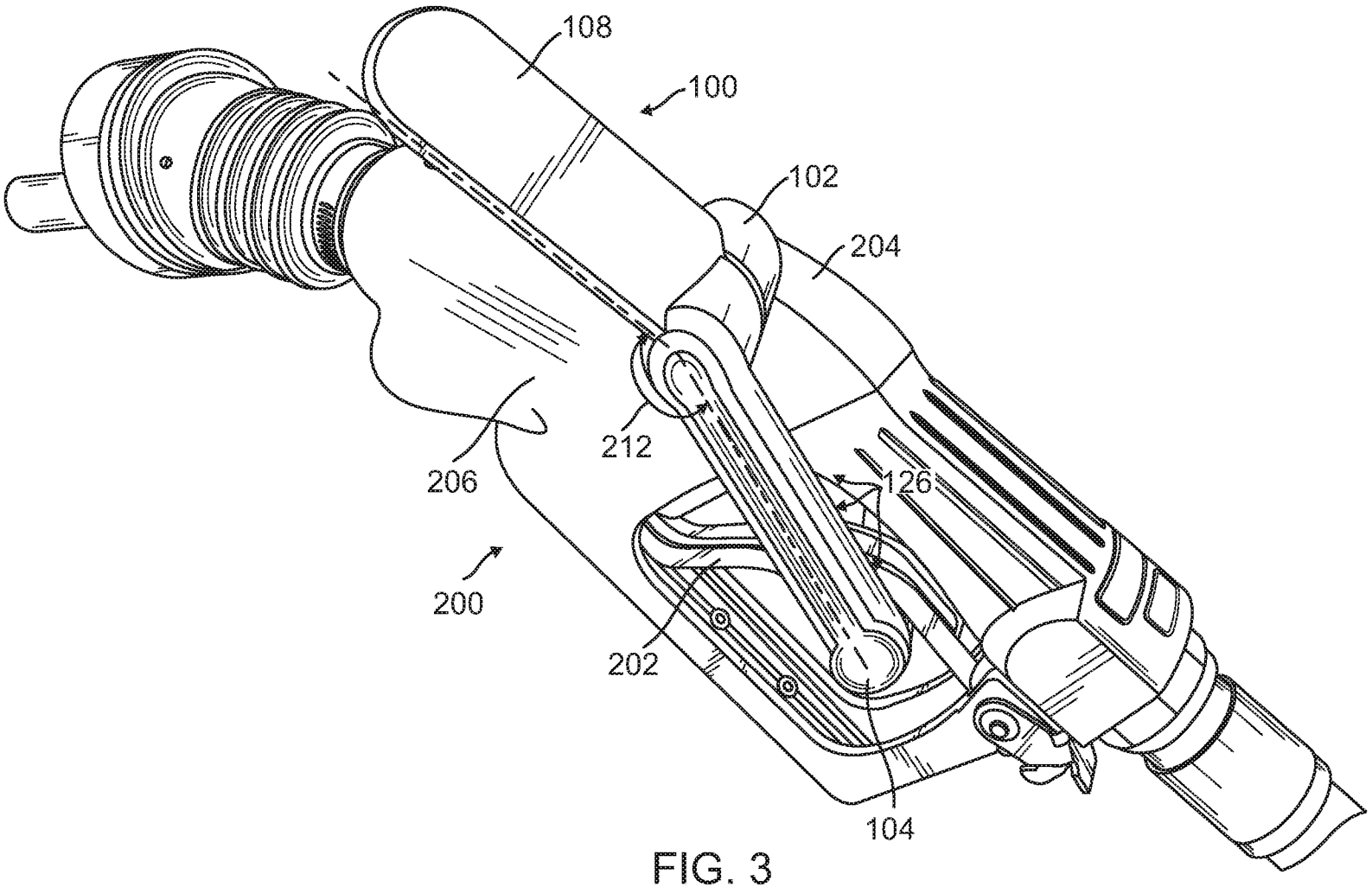
FIG. 3 illustrates the assistance lever shown in FIG. 1 mounted on the fuel nozzle after the handle of the fuel nozzle has been pressed by the assistance lever.

Referring now to FIG. 1, FIG. 2, and FIG. 3, FIG. 2 illustrates the assistance lever 100 engaging a fuel nozzle 200 of a fuel dispenser before the assistance lever 100 is turned to press the handle 202 of the fuel dispenser while FIG. 3 illustrates the assistance lever 100 pressing the handle 202 of the fuel nozzle 200 once the assistance lever 100 has been turned. The fulcrum post 102 is placed on a top ridge 204 of the fuel nozzle 200 and the handle post 104 is placed beneath the handle 202. A body 206 of the fuel nozzle 200 is placed in the gap 126 between the fulcrum post 102 and the handle post 104.

As shown in FIG. 2, once the fulcrum post 102 has been placed on the top ridge 204 of the fuel nozzle 200 and the handle post 104 is placed beneath the handle 202 of the fuel nozzle 200, a user can push the press member 108 towards the top ridge 204 of the fuel nozzle 200. This turns the assistance lever 100 about the fulcrum post 102 in a counter-clockwise direction. Since the support arm 106 is connected to the fulcrum post 102 and the handle post 104, the handle post 104 is turned upwards in a counter-clockwise direction when the user pushes on the press member 108. Thus, the handle post 104 pushes the handle 202 of the fuel nozzle 200 upwards and, as shown in FIG. 3, presses the handle 202 so that fuel is dispensed through the fuel nozzle 200. Since the press member 108 is positionable on the top ridge 204 of the fuel nozzle 200, a user can use their weight to push the press member 108 toward the top ridge 204. In this manner, a user that is unable to grip the fuel nozzle 200 can simply place the assistance lever 100 on the fuel nozzle 200 as described above and use their weight to dispense fuel into the desired vehicle or container.

The dimensions of the assistance lever 100 are designed based on the dimensions of the fuel nozzle 200. More specifically, the fulcrum post 102 has a length 208 (See FIG. 1) and the handle post 104 has a length 210 (See FIG. 1). The length 208 of the fulcrum post 102 and the length 210 of the handle post 104 are configured to be equal to or greater than a width of the top ridge 204 of the fuel nozzle 200. In this manner, the fulcrum post 102 and the handle post 104 distribute the pressure placed on the assistance lever 100 as much as possible and safely maintain the body 206 of the fuel nozzle 200 in the gap 126. In this embodiment, the length 208 and the length 210 are configured to be substantially equal to one another and substantially equal to the width of the top ridge 204. For example, the length 208 and the length 210 may be substantially equal to 6 cm. In this manner, the fulcrum post 102 and the handle post 104 do not extend past the body 206 of the fuel nozzle 200 at the lateral side 124.

Note that the handle post 104 and the press member 108 are connected by the support arm 106 so as to define an angle 212 between the press member 108 and the support arm 106. More specifically, the angle 212 is defined between a centerline of the press member 108 on the lateral side 122 and a centerline of the support arm 106 in an angular direction from the press member 108 to the support arm 106. The angle 212 is clearly less than 180 degrees. The problem is that, if the press member 108 and the support arm 106 were perfectly straight, the handle post 104 would fully press the handle 202 of the fuel nozzle 200 before the user presses the press member 108 against the top ridge 204 of the fuel nozzle 200. Accordingly, with the handle 202 fully pressed but with the press member 108 not yet lying flat against the top ridge 204, the user's weight would create an inordinate amount of pressure on the support arm 106, since the user's weight would continue pushing the handle 104 upward after the handle 202 is fully pressed. As such, this could cause the support arm 106 to snap.

Thus, in this embodiment, the angle 212 is provided between the press member 108 and the support arm 106 such that the angle 212 results in the handle 202 being substantially fully pressed once the user presses the handle post 104 against the top ridge 204 of the fuel nozzle 200 (See FIG. 3). Since the handle post 104 fully (or nearly fully) presses the handle 202 only when the press member 108 is pressed against the top ridge 204, the user's weight does not continue pushing the handle 202 upwards so that undue pressure is not exerted on the support arm 106. Of course, the value of the angle 212 will depend on the specific dimensions of the fuel nozzle 200. In this embodiment, the angle 212 is approximately 160 degrees.

Figure 4:
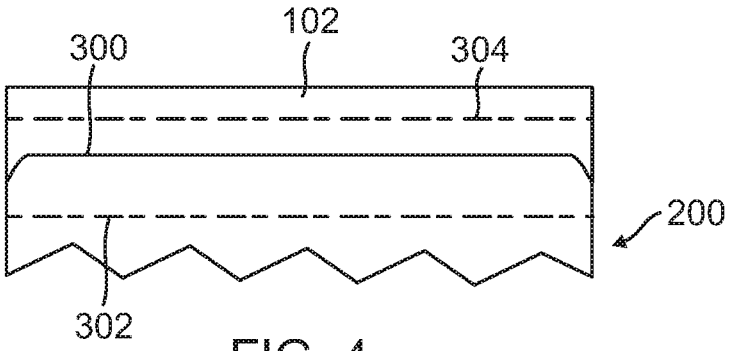
FIG. 4 is a cross sectional view that illustrates a bottom groove provided by a fulcrum post of the assistance lever shown in FIG. 1.

Referring now to FIG. 4, FIG. 4 illustrates one embodiment of the fulcrum post 102. In this embodiment, the fulcrum post 102 defines a bottom groove 300 configured to receive the top ridge 204 of the fuel nozzle 200. The bottom groove 300 ensures that the fulcrum post 102 remains engaged on the top ridge 204 when a user is applying their weight on the press member 108. For example, if the bottom groove 300 where not provided, any disbalance or lateral force caused when the user applies their weight to the press member 108 may result in the fulcrum post 300 slipping off the top ridge 204. However, by placing the top ridge 204 in the bottom groove 300, the bottom groove 300 resists disbalances and lateral forces and maintains the fulcrum post 102 engaged to the top ridge 204 of the fuel nozzle 200. As shown in FIG. 4, the top ridge 204 has a width 302 and a length 304 of the bottom groove 300 is approximately equal to the width 302 of the top ridge 204. In this manner, the top ridge 204 fits within the bottom groove 300 of the fulcrum post 102.

Figure 5:
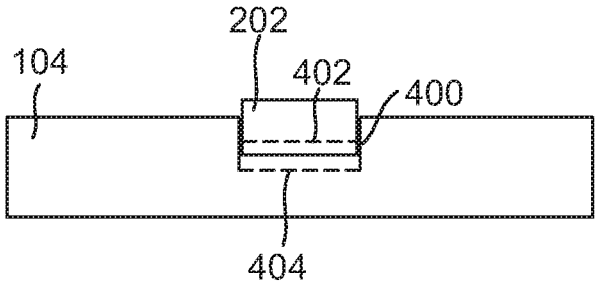
FIG. 5 is a cross sectional view that illustrates a top groove provided by a handle post of the assistance lever shown in FIG. 1.

Referring now to FIG. 5, FIG. 5 illustrates one embodiment of the handle post 104. In this embodiment, the handle post 104 defines a top groove 400 configured to receive the handle 202 of the fuel nozzle 200 (See FIG. 1). The top groove 400 ensures that the handle post 104 remains engaged to the handle 202 when a user is applying their weight on the press member 108. For example, if the top groove 400 where not provided, any disbalance or lateral force caused when the user applies their weight to the press member 108 may result in the handle post 400 slipping off the handle 202. However, by placing the handle 202 in the top groove 400, the top groove 400 resists disbalances and lateral forces and maintains the handle post 104 engaged to the handle 202 of the fuel nozzle 200. As shown in FIG. 5, the handle has a width 402 and a length 404 of the top groove 400 is approximately equal to the width 402 of the handle 202. In this manner, the handle 202 fits within the top groove 400 of the handle post 104.

The assistance lever 100 described above with respect to FIG. 1-FIG. 5 is simply one embodiment and other designs and modifications can be used depending on the particular embodiment of the fuel nozzle 200 that the assistance lever 100 is designed for. It should be noted that the assistance lever 100 could be formed from any suitable material, such as a plastic, a metal, and/or the like. However, due to safety concerns, the assistance lever 100 is preferably formed from a plastic with a high resistance to static electricity. It should be further noted that in general, the assistance lever 100 is designed so as not to lock the handle 202 of the fuel nozzle 200 as this would be a safety hazard and may run counter to current regulations.

Those skilled in the art will recognize improvements and modification to the preferred embodiments of the present disclosure. All such improvements and modifications are considered within the scope of the concepts disclosed herein and the claims that follow.

What is claimed is:

1. An assistance lever that assists a user to operate a fuel nozzle at a fuel dispenser, comprising:

a fulcrum post positionable on a top ridge of the fuel nozzle, wherein the fulcrum post defines a bottom groove configured to receive the top ridge of the fuel nozzle;

a handle post;

a support arm connected between the fulcrum post and the handle post such that the handle post is positionable beneath a handle of the fuel nozzle; and a press member attached to the fulcrum post and positioned to turn the assistance lever about the fulcrum post when pressed by the user such that the handle post presses the handle of the fuel nozzle.

2. The assistance lever of claim 1, wherein the handle post and the press member are connected by the fulcrum post such that an angle between the press member and the support arm results in the handle being fully pressed once the user presses the handle post against the top ridge of the fuel nozzle.

3. The assistance lever of claim 1, wherein:

the fulcrum post has a first end and an oppositely disposed second end; and the press member is attached so as to extend out of the fulcrum post between the first end and the second end.

4. The assistance lever of claim 1, wherein:

the fulcrum post has a first end on a first lateral side of the assistance lever;

the handle post having a second end on the first lateral side of the assistance lever; and wherein the support arm is attached to the first end and is attached to the second end so that a body of the fuel nozzle is positionable between the fulcrum post and the handle post.

5. The assistance lever of claim 4, wherein a first length of the fulcrum post and a second length of the handle post are each configured to be equal to or greater than a width of the top ridge of the fuel nozzle.

6. The assistance lever of claim 5, wherein the first length and the second length are equal.

7. The assistance lever of claim 6, wherein the first length and the second length are provided so as to be equal to the width of the fuel nozzle.

8. The assistance lever of claim 1, wherein the fulcrum post is configured to have a length equal to or greater than a width of the top ridge of the fuel nozzle.

9. The assistance lever of claim 1, wherein the handle post is configured to have a length equal to or greater than a width of the top ridge of the fuel nozzle.

10. The assistance lever of claim 1, wherein the press member comprises a press pad.

11. The assistance lever of claim 1, wherein the handle post defines a top groove configured to receive the handle of the fuel nozzle.

12. An assistance lever that assists a use to operate a fuel nozzle at a fuel dispenser, comprising:

a handle post;

a press pad;

a support arm coupled between the handle post and the press pad such that:

the handle post is positionable beneath a handle of the fuel nozzle and the handle post defines a top groove configured to receive the handle of the fuel nozzle; and pressing the press pad toward a top ridge of the fuel nozzle results in the handle post presses the handle of the fuel nozzle.

13. The assistance lever of claim 12, wherein the handle post and the press pad are connected by the support arm such that an angle between the press pad and the support arm results in the handle being fully pressed once the user presses the handle post against the top ridge of the fuel nozzle.

14. The assistance lever of claim 12, further comprising a fulcrum post, wherein the fulcrum post defines a post surface and the press pad is attached to the fulcrum post so as to extend out of the post surface.

15. The assistance lever of claim 14, wherein:

the fulcrum post has a first end and an oppositely disposed second end; and the fulcrum post defines the post surface between the first end and the second end of the post surface.

16. The assistance lever of claim 14, wherein:

the fulcrum post has a first end on a first lateral side of the assistance lever;

the handle post having a second end on the first lateral side of the assistance lever; and wherein the support arm is attached to the first end and is attached to the second end so that a body of the fuel nozzle is positionable between the fulcrum post and the handle post.

17. The assistance lever of claim 14, wherein the fulcrum post defines a bottom groove configured to receive the top ridge of the fuel nozzle.

18. An assistance lever that assists a user to operate a fuel nozzle at a fuel dispenser, comprising:

a fulcrum post positionable on a top ridge of the fuel nozzle;

a handle post, wherein the handle post defines a top groove configured to receive a handle of the fuel nozzle;

a support arm connected between the fulcrum post and the handle post such that the handle post is positionable beneath the handle of the fuel nozzle; and a press member attached to the fulcrum post and positioned to turn the assistance lever about the fulcrum post when pressed by the user such that the handle post presses the handle of the fuel nozzle.

19. The assistance lever of claim 18, wherein the fulcrum post defines a bottom groove configured to receive the top ridge of the fuel nozzle.

20. The assistance lever of claim 18, wherein the fulcrum post is configured to have a length equal to or greater than a width of the top ridge of the fuel nozzle.

* * * * *